US005165642A

United States Patent [19]

Rihaly

[11] Patent Number: 5,165,642

[45] Date of Patent: Nov. 24, 1992

[54] SHINGLE HOLDER

[76] Inventor: John Rihaly, 7311 Highland St., Bldg. 9A, Springfield, Va. 22150

[21] Appl. No.: 480,922

[22] Filed: Feb. 16, 1990

[51] Int. Cl.[5] ..... E04G 27/00

[52] U.S. Cl. ..... 248/237; 182/45

[58] Field of Search ..... 248/237; 182/45

[56] References Cited

U.S. PATENT DOCUMENTS

| | | | |
|---|---|---|---|
| 72,762 | 12/1868 | Taft . | |
| 79,415 | 6/1868 | Turner | 248/237 |
| 236,587 | 1/1881 | Hoerner . | |
| 302,157 | 7/1884 | Porter . | |
| 518,838 | 4/1894 | Flowers . | |
| 723,229 | 3/1903 | Bartlett . | |
| 753,531 | 3/1904 | Adams . | |
| 993,341 | 5/1911 | Botten . | |
| 1,016,935 | 4/1913 | Clark . | |
| 1,074,382 | 9/1913 | Richards . | |
| 1,154,855 | 9/1915 | Gallup . | |
| 1,159,372 | 11/1915 | Goff . | |
| 1,201,779 | 10/1916 | Wellendorf . | |
| 1,339,458 | 5/1920 | Jansma . | |
| 1,661,192 | 3/1928 | Nelson . | |
| 1,803,788 | 5/1931 | Brown . | |
| 1,864,457 | 6/1932 | Nelson | 248/237 |
| 2,219,971 | 10/1940 | Allard | 248/237 |
| 2,845,206 | 7/1958 | Currie . | |
| 4,078,633 | 3/1978 | Fahy | 182/45 X |
| 4,230,202 | 10/1980 | Kudra, III . | |
| 4,676,341 | 6/1987 | Shaffstall | 182/45 |
| 4,928,789 | 5/1990 | Clacys | 182/45 X |
| 4,946,123 | 8/1990 | Albert | 182/45 X |

FOREIGN PATENT DOCUMENTS

| | | | |
|---|---|---|---|
| 0651175 | 3/1951 | United Kingdom | 182/45 |
| 0919971 | 2/1963 | United Kingdom | 182/45 |
| 2131475 | 6/1984 | United Kingdom | 182/45 |

*Primary Examiner*—Karen J. Chotkowski
*Assistant Examiner*—Derek J. Berger
*Attorney, Agent, or Firm*—Larson and Taylor

[57] ABSTRACT

A shingle holder adheres to the slanted surface of a roof by means of frictional material on its underside the and holder a supply of shingles, or similar roof covering materials such as cedar shakes, securely in place and accessible to the roofer in applying the shingles to the slanted roof surface. The shingle holder comprises a rigid T-shaped structure that lies flat on the roof, with the material on the underside making frictional engagement with the roof surface under the weight of the shingles. Arm supports extend upward from a lowermost base of the T-shaped structure to support the roofing materials.

9 Claims, 4 Drawing Sheets

SHINGLE HOLDER

FIELD OF THE INVENTION

This invention relates to shingle holders for use in holding shingles in the course of building a new roof, or in repairing or replacing a shingled roof.

BACKGROUND OF THE INVENTION

In the course of building construction, a new roof is installed over a plywood base of a new building. The roof is typically made of shingles, with a single asphalt shingle being of rectangular shape, and having dimensions generally of 12 inches by 36 inches. When a roofer is installing a new roof, it is thus necessary for him to have readily at hand a large number of shingles. Shingles are grouped into "bundles", with each bundle of, for example, asphalt shingles containing approximately 24 shingles and having a weight of approximately 75 pounds. Since roofs are usually constructed slanted at various angles, extreme care is required by the roofer during the course of his work in installing a new roof or in repairing or replacing old shingles.

A procedure used by roofers at the present time is to pile a sufficient supply of shingles on a top crest of the roof structure, and then to bring down a few at a time to an area for installing the shingles to the plywood roof base. A nail is driven into the roof and a stack of shingles are leaned against the nail, holding the stack as the shingles are installed. A roofer installs the shingles, one overlapping the other, by starting from the bottom, or lowest point on a roof, and working upwards towards the crest of the roof. Therefore, the nail driven into the roof to hold a ready supply of shingles is nailed into new shingles already installed as part of a new roof. Obvious damage to the newly placed shingles therefore occurs, and the roofer is limited in the number of shingles which he can bring down from the top crest to his work position at any given time. Thus, additional time is added to the work in replenishing the shingle supply with trips to the top crest of the roof, and also in driving the nails as "holders", as the new roof installation progresses. These drawbacks and disadvantages make desirable a means for providing a roofer with a ready supply of asphalt shingles for installation in the construction of a new roof, and suitable means for holding a bundle of shingles, which does not cause damage to the shingles or other parts of the roof surface.

One possibility for providing such a ready supply of shingles to a roofer is a rack type device that is placed against a roof for holding shingles as described in U.S. Pat. No. 1,339,458. However, the use of such a rack or support platform has the disadvantage of relying upon pointed spikes or claw members to engage in the shingles on the roof to hold the rack in place. Also, roofing aids are known that make use of a pad or cushion of surface adhering material. However, these have been used only in connection with clothing worn by a roofer, as part of the knees or seat sections of clothing.

SUMMARY OF THE INVENTION

It is, therefore, a primary object of this invention to provide a new and improved shingle holder that rigidly and securely adheres to the surface of a shingled roof without penetrating or otherwise causing damage to the roof, nor requiring the use of extra attachments to the shingle holder, such as spikes, claws, and the like, in order to maintain it securely in place.

Another object of the invention is to provide a shingle holder of simple structure that is portable and lightweight so as to be convenient and easily movable by the roofer during the course of his work, and able to accommodate a full bundle of shingles.

With these objects in view, the shingle holder of the present invention comprises a base adapted to lie essentially flat against the roof and having upright means extending up from the base, the base being lowermost when the shingle holder lies flat on the roof and supports a bundle of shingles. The shingle holder further comprises friction means on the bottom of the base to prevent it from sliding down the slanted roof. In one embodiment, this frictional means comprises a first frictional material that covers a substantial portion of the base and is relatively soft so as to assure holding frictional engagement between the base and the slanted roof, and a second frictional material, much harder than the first frictional material, that extends along the bottom edge of the base, which is along its lowermost edge when positioned on a slanted roof, wherein the second frictional material constitutes a means for preventing peeling of the first frictional material due to gravitational forces urging the shingle holder down the slanted roof.

In another embodiment, this frictional means comprises a single piece of frictional material that covers substantial portion of the base and is of such a texture as to assure holding frictional engagement between the base and the slanted roof, while the texture is also sufficient to prevent peeling of the frictional material away from the bottom leading edge of the base.

In still another embodiment, the upright means extending from the lower edge of the base have connected between them mesh support means for providing additional support to a bundle of shingles.

In still another embodiment, the shingle holder of the invention is constructed with triangular shaped upright means for use in a heavy duty type of shingle holder for supporting multiple bundles of shingles.

BRIEF DESCRIPTION OF THE DRAWINGS

The invention will become more readily apparent from the following exemplary description taken in conjunction with the accompanying drawings, in which.

DETAILED DESCRIPTION OF THE PREFERRED EMBODIMENTS

Figure 1:
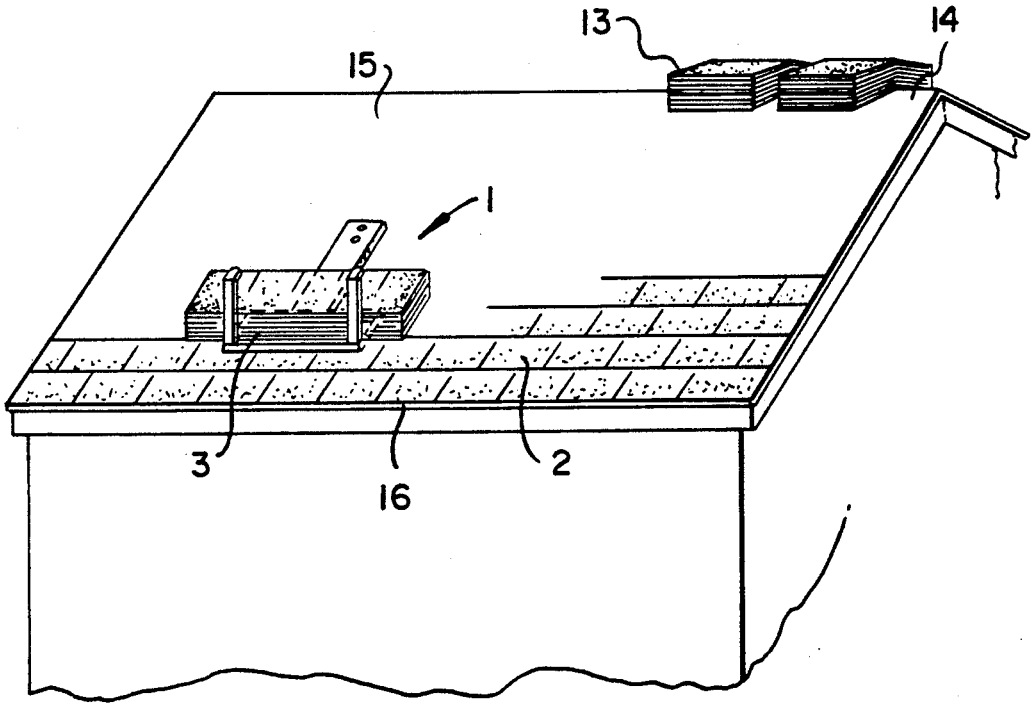
FIG. 1 illustrates a roof being shingled, together with the shingle holder of the present invention shown positioned on the roof.
Figure 2:
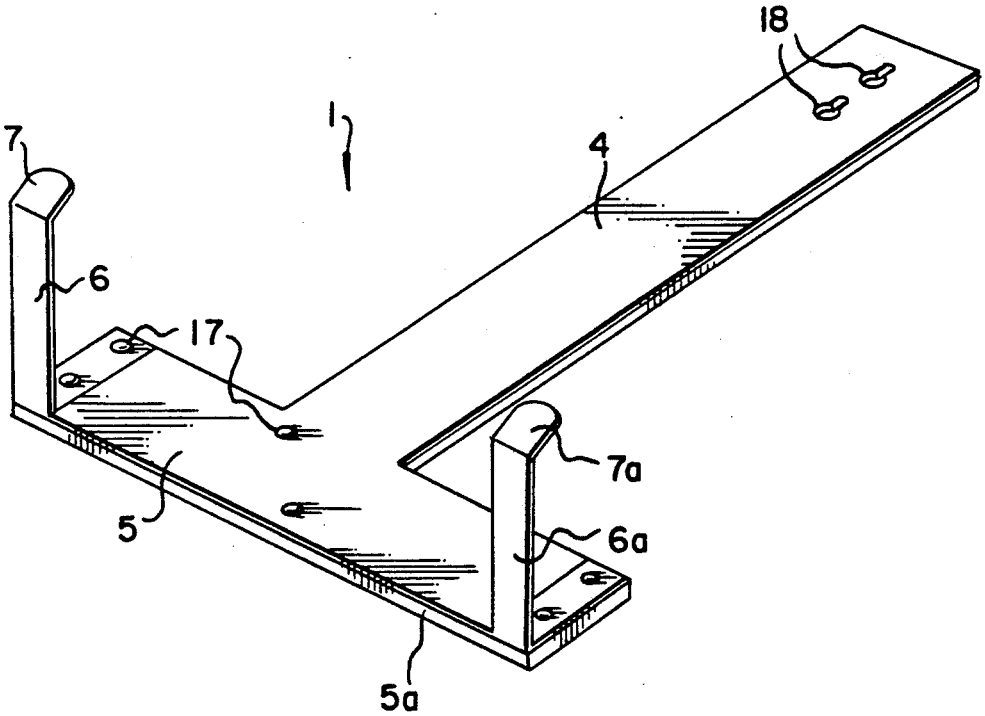
FIG. 2 is an enlarged perspective view of a shingle holder according to a first embodiment of the present invention.

FIG. 1 illustrates a shingle holder 1 constructed in accordance with the invention, positioned in place on the surface of a roof 2 under construction, and holding a supply 3 of asphalt shingles. In a preferred embodiment of the shingle holder 1, as shown in FIG. 2, its base is a rigid T structure comprising a straight arm 4 rigidly attached to the center of a support 5 which forms the cross member of the T. Rivets 17 or other suitable fastening means are used to connect arm 4 to support 5. Typically, the length of arm 4 down to support 5 is 13½ inches by 2½ inches, and the length of the support 5 is 9½ inches by 2½ inches.

Extending substantially perpendicularly from support 5 are two arms 6, 6*a*, typically 5½ inches in length, and 1½ inches wide, with each arm having an extension 7, 7*a*, bent upwardly at an angle of approximately 45 degrees, and extending 1 inch outwardly at the same 1½ inch width. Each arm 6, 6*a* is rigidly attached to support 5 by rivets 17 or other suitable fastening means.

Two apertures 18 are made in the upper end of arm 4 as a means for nailing the shingle holder to the roof deck for extra support if needed.

Figure 3:
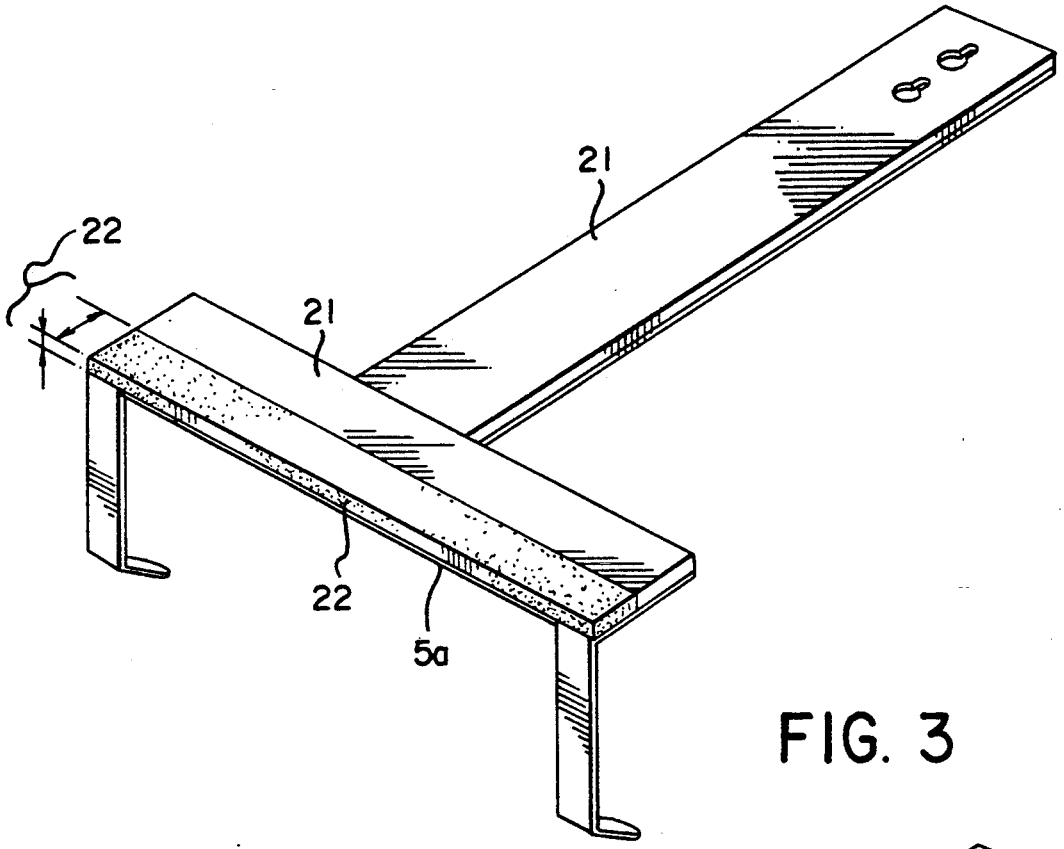
FIG. 3 is a perspective view of the underside of the shingle holder of FIG. 1.

FIG. 3 shows the underside of the shingle holder 1 of FIG. 2, according to one embodiment, wherein the underside is covered with a matting comprising two types of frictional materials, 21 and 22. Material 21 is relatively soft so as to provide the primary frictional adherence of the shingle holder 1 to the roof surface 2 and may, for example, consist of a rubber such as Black (2091) SCE - 41, Neopreme 107 split. As illustrated, material 21 covers practically the entire underside of the shingle holder, except for a front bumper region 22 that extends lengthwise across the underside of the front region of support 5 and extends rearwardly approximately ½ inch from the front leading edge 5*a* thereof. Material 22, which is much harder material 21, and serves two purposes. First, it provides additional frictional adherence which holds the shingle holder and its contents in a fixed position on a roof. In addition, because material 22 is much harder than material 21, it prevents a tearing away of the leading edge of the underside rubber matting (this matting comprising in this embodiment both materials 21 and 22) which could otherwise occur due to the downward force exerted by the weight of the shingles 3 being held on the shingle holder 1. Such tearing away could occur because the weight of the shingles, while needed to provide the frictional force to hold the shingle holder on the slanted roof, also creates a downward force on the main portions of arm 4 and support 5, relative to the matting, tending to separate the matting (materials 21 and 22) from said main parts. Such tearing away would occur first at the leading edge 5*a* of the matting. But because the front part of this matting comprises a harder material 22, it resists such tearing effect. Material 22 may, for example, consist of 18 Iron Euante—sweats grey F-493.

Both materials 21 and 22 are adhered to the rigid members 4, 5 by means of a strong glue material such as, for example, Barge Rubber Contact Cement (adhesive), or other suitable liquid fastening compound.

Figure 4:
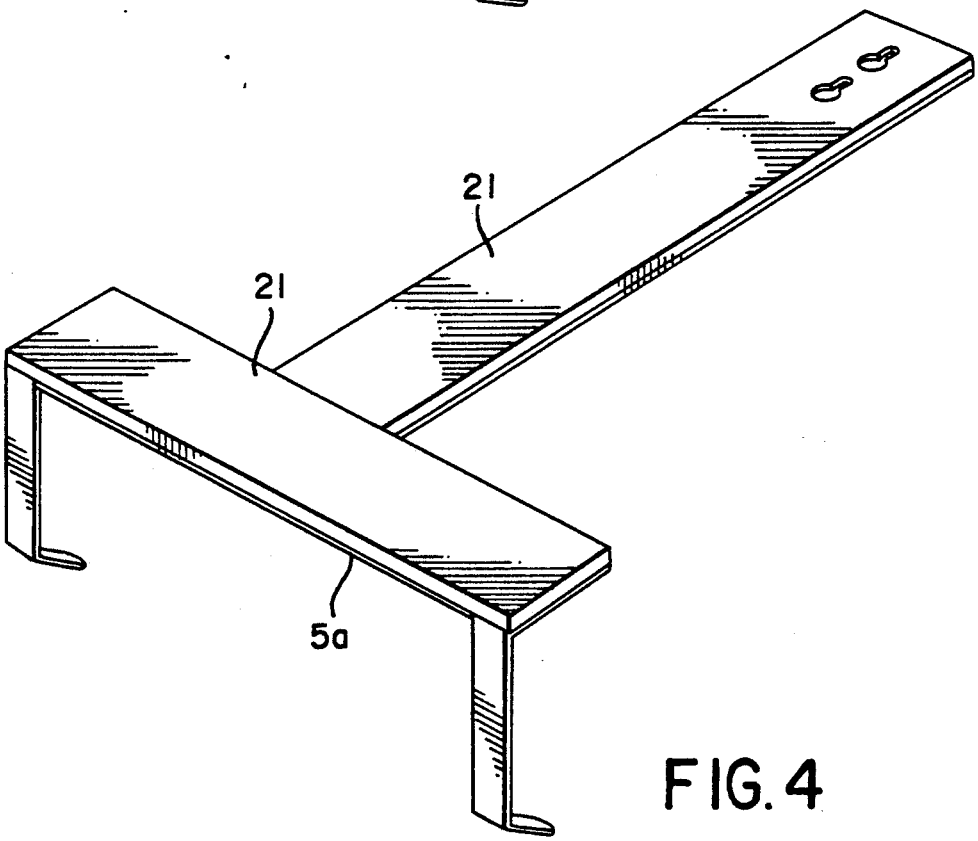
FIG. 4 is a perspective view of the underside of a shingle holder similar to that of FIG. 1 but comprising another embodiment of the invention.

In an alternative embodiment, if the above noted tendency of the underside matting to tear away were not a significant problem, the underside construction of the shingle holder could be formed of a single frictional material, such as the softer rubber material 21, as shown in FIG. 4. Such a construction would have the advantage of providing a less costly model while offering essentially the same degree of frictional adherence of the shingle holder to the surface of a roof. In this embodiment, a material such as Rubberlite, SBE 43 ECH could be applied as the single frictional material to the underside of the shingle holder. This particular Rubberlite material, being more dense than many other types of rubber materials, provides both substantial adhesion to securely hold the shingle holder in place on the roof surface and also guards against a tearing away of the front leading edge of the shingle holder.

Figure 5:
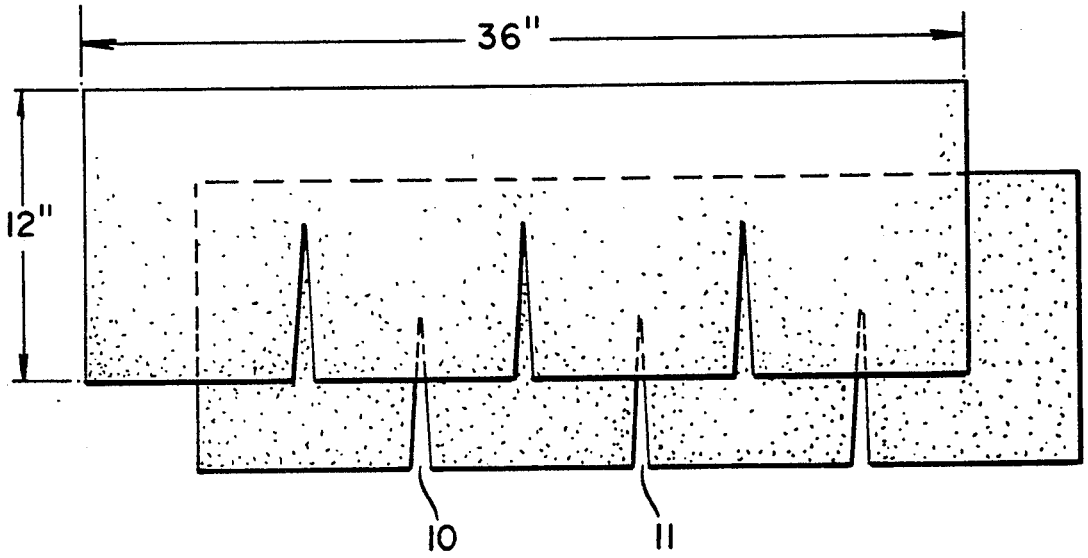
FIG. 5 illustrates two shingles, one superimposed over the other as would occur when attached to a roof.

FIG. 5 shows two typical asphalt shingles overlapping one another in a position as they would normally be installed on a roof surface. Outwardly it would appear that the individual shingles are much smaller than they actually are due to the notched recesses 10, 11 that remain exposed after multiple shingles are installed in the overlapping manner as depicted to form the roof surface. Yet, each shingle is actually approximately 36 inches by 12 inches as illustrated in FIG. 5.

Figure 6:
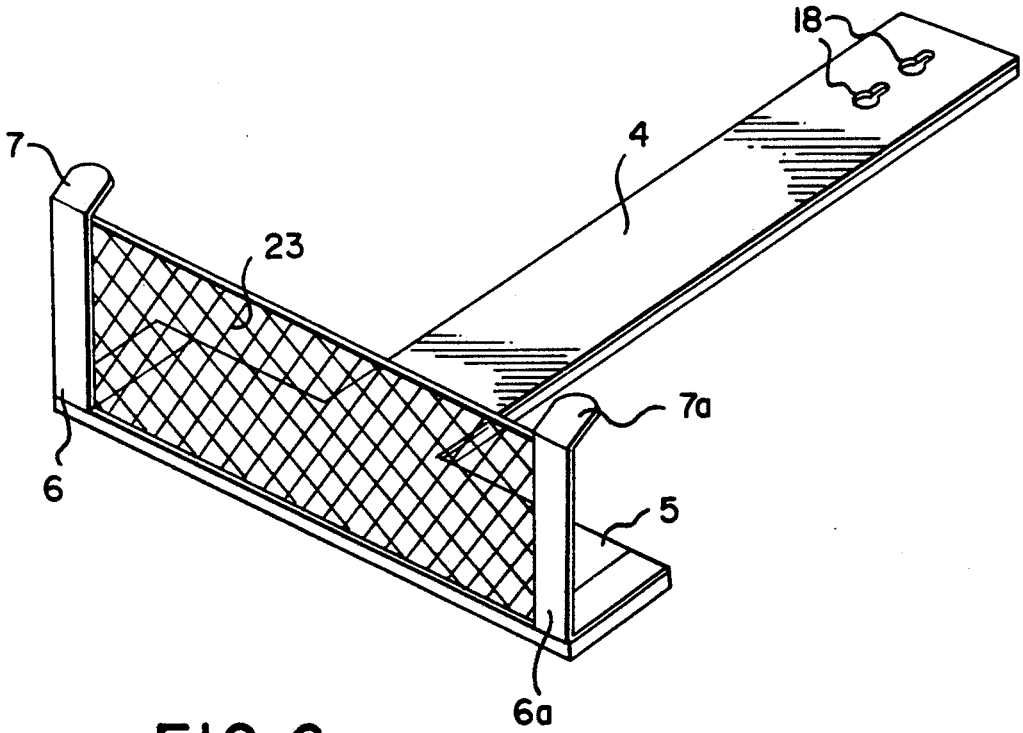
FIG. 6 is a perspective view of another embodiment of a shingle holder according to the present invention.
Figure 7:
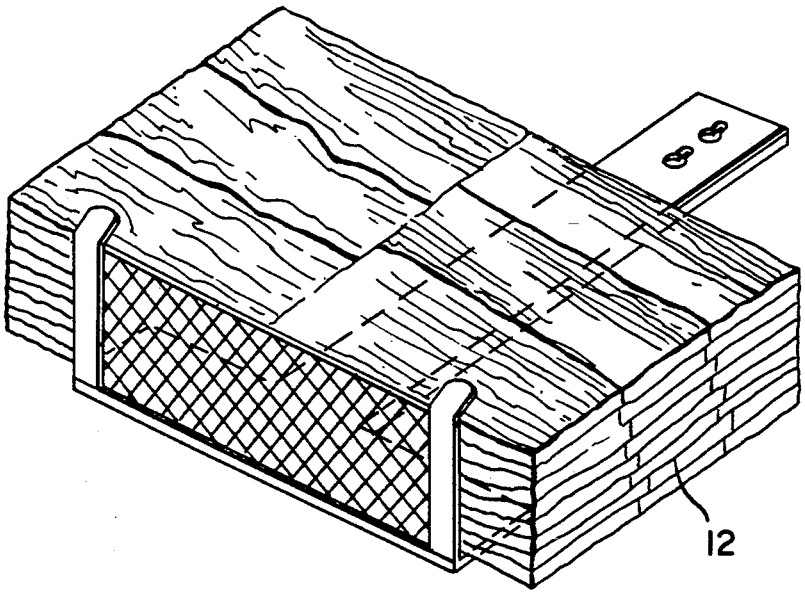
FIG. 7 shows the shingle holder of FIG. 6, holding a stack of cedar shakes.

Shingles bought for installation by a roofer come in "bundles". The most common type of shingle is asphalt. Each bundle of asphalt shingles usually contains twenty-four shingles, has a weight of approximately 75 pounds and a height of about 5½ inches. A preferred embodiment of the invention, as shown in FIGS. 2 and 3, would be used primarily to hold a bundle of asphalt shingles. The invention, however, could also be constructed with a screen 23 connecting the two upright arms 6, 6*a*, as shown in FIG. 6. In addition to being used with asphalt shingles, this embodiment of the invention could also be used as a carrier for other types of roofing materials, such as cedar shakes, which are lighter in weight but have a thickness of from ½ inch to 1 inch apiece and are more irregular in their shape than are asphalt shingles. This alternative embodiment of the invention with the supporting screen 23 between the arms is shown in FIG. 7 holding a stack of bundled cedar shakes 12.

Figure 8:
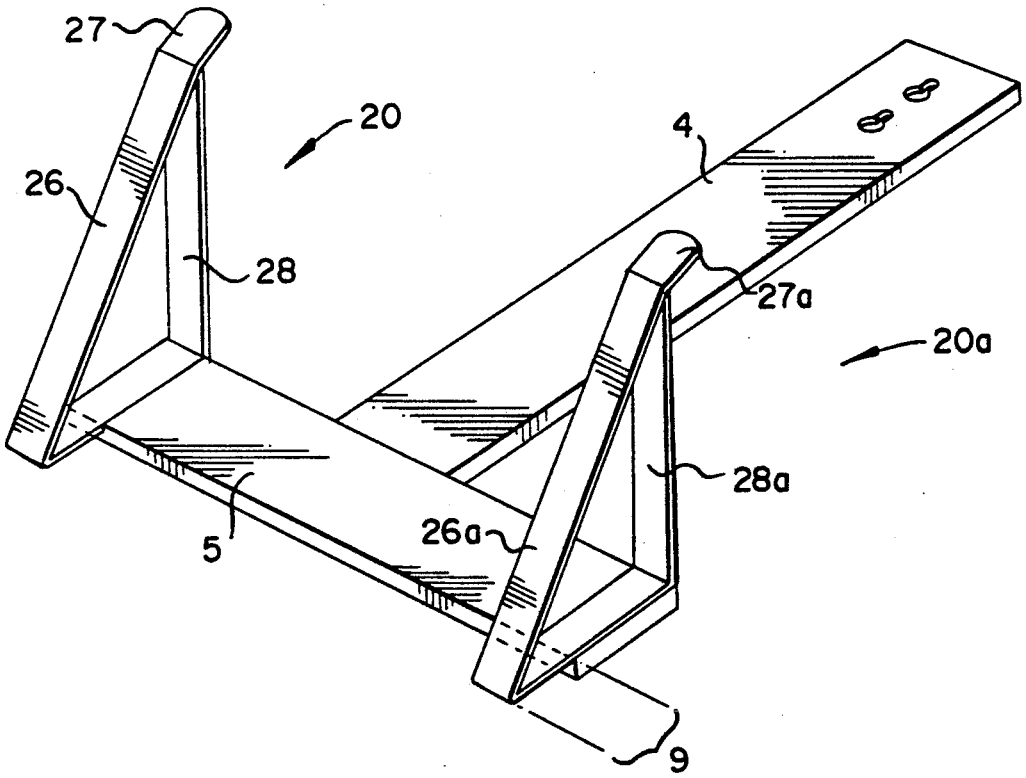
FIG. 8 is a perspective view of another embodiment of a shingle holder according to the present invention for holding multiple bundles of shingles.

In another alternative embodiment, the shingle holder can be constructed with triangular shaped uprights 20, 20*a* attached to, and extending upwardly from base support 5, as shown in FIG. 8. This provides a heavy-duty type of shingle holder according to the invention for use in supporting the added weight and sides of multiple bundles of shingles. The embodiment illustrated in FIG. 8 is useful in typically supporting four bundles of shingles. In this embodiment, typical dimensions of arm 4 are 16 inches by 3 inches, while base support 5 is 18 inches by 3 inches. Each triangular upright 20, 20*a*, is normally of the same dimensions as each other, typically with arms 26, 26*a* being 11 and ⅞ inches, extensions 27, 27*a* being 1½ inches wide and extending outward 1 inch from arms 26, 26*a*. Supports 28, 28*a* are typically 11 inches from base support 5 to the beginning of arm extension 27, 27*a*, and the base of each upright 20, 20*a*, extends beyond base support 5 at 9 by typically 1½ inches. This heavy-duty construction as described and shown in FIG. 8, with dimensions as indicated, provides a solid shingle holder for supporting four bundles of asphalt shingles at the same time, having dimensions and weight as indicated previously herein.

The invention would operate as follows. Considering a typical series of steps followed by a roofer, the roofer would first have shingles 13 brought up and placed on a crest 14 (high point) of the roof. He would then load up the shingle holder with a bundle of shingles and place the holder flat on the slanted roof of a building under construction, as shown in FIG. 1. The roof is formed by installing the shingles, one overlapping the other (see FIG. 4), generally on a plywood base or other form of roof support 15, starting from the lowermost part of the roof 16 and working upwards to the top or crest 14 of the roof. Once shingles within a given area have been installed, the roofer moves the shingle holder up the roof to a new spot, reloads it with shingles, and continues installing the remaining shingles. A new shingle bundle is added as needed, with the shingle holder being moved gradually upwards on the roof as the roof construction (or repair) is completed.

From the foregoing, it is seen that this invention is well adapted to attain all of the ends and objects hereinabove set forth, together with other advantages which are apparent and which are inherent in the device. The dimensions as listed are those of preferred embodiments, and may be varied without departing from the spirit and scope of the invention.

The terms and expressions which have been employed herein are used as terms of description and not of limitation, and there is no intention by the use of such terms and expressions of excluding equivalents of the features shown and described, or portions thereof, it being recognized that various modifications are possible within the scope of the invention.

I claim.

1. In combination, a shingle holder mounted on a slanted roof to facilitate accessibility of shingles to the roofer and a bundle of shingles resting thereon, comprising:

a base lying essentially flat against the slanted roof, said base having an arm portion having a longitudinal axis extending in the direction up and down the slant of the roof and a transverse support portion, also flat against the slanted roof, extending substantially 90° relative to the arm portion, so as to extend across the slant of the roof, upright means extending upwardly from the lowermost edge of the support portion at an angle of substantially 90° thereto and hence substantially 90° to the surface of the slanted roof, the upright means including at least one portion located on each side of a center line through the longitudinal axis of said arm portion, each portion disposed a sufficient distance from said center line to support the said bundle of shingles in a stable manner, the bundle of shingles lying on the arm portion and the support portion with the shingle edges resting against the upright means, and a friction means comprising frictional material covering a substantial portion of the bottom of the base to frictionally engage the slanted roof with a sufficient holding force that the shingle holder and the weight of the bundle of shingles thereon are prevented from sliding down the slanted roof.

2. The combination of claim 1, wherein said upright means comprises two extension arms evenly spaced a predetermined distance from either side of said centerline, each extension arm having an upper end part away from the support portion that is turned at substantially a 45° angle from a plane of the upright means.

3. The combination of claim 1, wherein said arm portion has dimensions of approximately 13½ inches by 2½ inches, and said support portion has dimensions of approximately 9½ inches by 2½ inches, with the upright means being approximately 5½ inches by 1½ inches.

4. The combination of claim 1, wherein both the arm portion and the support portion, and the support portion and the upright means, are rigidly attached to each other by welding.

5. The combination of claim 1, wherein the arm, support and upright means are rigidly attached together by rivets.

6. The combination of claim 1, wherein said friction means comprises a single frictional material made of rubber compound.

7. The combination of claim 6, wherein said rubber compound is Rubber lite SBE 43 ECH.

8. The combination of claim 1, said frictional means the friction means comprising a material made of a rubber compound for preventing movement of said holder when lying flat on said slanted surface.

9. The combination of claim 8, wherein the rubber compound is Rubber lite SBE 43 ECH.

* * * * *